US005141229A

United States Patent [19]

Roundy

[11] Patent Number: 5,141,229

[45] Date of Patent: Aug. 25, 1992

[54] ACCELERATION AND DECELERATION ELECTRICAL SWITCH

[75] Inventor: Terry B. Roundy, Teton, Id.

[73] Assignee: Sure Trak, Inc., Rexburg, Id.

[21] Appl. No.: 580,312

[22] Filed: Sep. 10, 1990

[51] Int. Cl.[5] ..... A63B 65/02; H01H 35/14

[52] U.S. Cl. ..... 273/416; 200/61.53

[58] Field of Search ..... 200/6 BA, 61.45 R, 61.45 M, 200/61.53; 273/416

[56] References Cited

U.S. PATENT DOCUMENTS

| | | | |
|---|---|---|---|
| Re. 33,470 | 12/1990 | Boy et al. | 342/386 |
| 1,845,848 | 2/1932 | Richards | 200/61.53 |
| 3,632,920 | 1/1972 | Tetrault | 200/61.53 |
| 3,638,181 | 1/1972 | Bryant | 340/467 |
| 3,859,482 | 1/1975 | Matsui et al. | 200/61.08 |
| 4,093,836 | 6/1978 | Ewy et al. | 200/61.53 |
| 4,184,057 | 1/1980 | Kumita et al. | 200/61.45 R |
| 4,201,898 | 5/1980 | Jones et al. | 200/61.45 R |
| 4,311,891 | 1/1982 | Faust | 200/61.45 R |
| 4,340,930 | 7/1982 | Carissimi | 362/204 |
| 4,371,763 | 2/1983 | Jackman et al. | 200/61.45 R |
| 4,421,319 | 12/1983 | Murphy | 273/416 |
| 4,533,801 | 8/1985 | Jackman et al. | 200/61.45 R |
| 4,675,683 | 6/1987 | Robinson et al. | 342/386 |
| 4,697,053 | 9/1987 | Lockard | 200/6 BA X |
| 4,704,612 | 11/1987 | Bay et al. | 342/386 |
| 4,746,774 | 5/1988 | Tetrault et al. | 200/61.45 R |
| 4,749,198 | 6/1988 | Braileau | 273/416 |
| 4,873,401 | 10/1989 | Ireland | 200/61.53 X |
| 4,885,800 | 12/1989 | Ragle | 455/98 |
| 4,932,260 | 6/1990 | Norton | 200/61.53 X |
| 4,940,245 | 7/1990 | Bittle, Jr. | 273/416 |
| 5,024,447 | 6/1991 | Jude | 273/416 |

*Primary Examiner*—J. R. Scott

*Attorney, Agent, or Firm*—Thorpe, North & Western

[57] ABSTRACT

An electrical inertia switch that closes a first electrical contact upon switch acceleration and closes a second electrical contact upon switch deceleration. The miniature switch can be inserted within an archer's arrow and used to activate a radio transmitter signal so as to locate the arrow by a directional signal receiver from a remote location.

10 Claims, 2 Drawing Sheets

ACCELERATION AND DECELERATION ELECTRICAL SWITCH

FIELD OF THE INVENTION

The present invention relates to a small inertia-activated electrical switch that can be contained within a projectile such as an arrow, such that acceleration or deceleration will move a spring-loaded mass to make electrical contact and activate an electrical circuit. This type of switch can be used, for instance, to activate a small radio transmitter within an arrow during acceleration (shooting) or deceleration (stopping) of the arrow. In a preferred embodiment, the switch has a pair of electrical contacts, one at each end of the metal switch housing, a pair of springs maintain the mass in a middle or centered "off" position until acceleration moves the mass to a second position at one end making a first contact and then deceleration moves the mass to a third position at the opposite end, to close a second contact.

The function of the switch is to conserve the battery of the arrow shaft transmitter until the arrow is actually shot from the bow, or as a backup, strikes the target or ground.

BACKGROUND OF THE INVENTION

The bow hunting of big game animals is increasing in popularity in the United States. White-tailed deer, mule deer, elk, antelope, and bear are only a few of the species currently being hunted. State-of-the-art hunting arrows typically have a hollow fiberglass or aluminum shaft and are provided with a removable and interchangeable tip, or "broadhead". The type, size, weight, etc., of a broadhead may be changed depending upon the animal hunted, the weather conditions, the terrain, etc. Such arrows are quite expensive, typically ranging in price from $5.00 to $7.00.

Two problems that are common with bow hunters are: (1) locating the arrow resulting from a missed shot, and (2) locating the injured animal (if an immediate kill is not made) resulting from a successful shot. Even the best of hunters miss their target about 20–25% of the time, and less experienced hunters even more. When shooting from a range of 50–100 yards, it is not uncommon to lose the arrows resulting from errant shots. A typical hunter may lose 10–20 arrows per year, resulting in substantial financial loss. Even more importantly, however, the loss of game resulting from successful shots is significant. While it is possible to drop a smaller animal immediately with a well-placed shot, larger animals such as deer, elk, bear, etc., are seldom instantly killed by an arrow. Whether the arrow passes completely through the animal or remains imbedded therein, the animal may run from a few hundred yards to two miles before either dying or resting.

Hunting arrows have been developed which contain transmitters, enabling the bow hunter with a receiving unit to locate either the arrow after an errant snot, or the quarry after a successful shot, presuming the arrow remains imbedded in the quarry. For instance, U.S. Pat. No. 4,749,198 discloses a battery-powered transmitter located behind the arrow tip and having an antenna extending through the shaft of the arrow. The transmitter is activated by rotation of the arrow tip by the archer prior to shooting. The arrow of U.S. Pat. No. 4,421,319 includes an audible signal device in the nock of the arrow. The switch on this device is located on the nock of the arrow and is an on-off pushbutton-activated by the archer. U.S. Pat. No. 4,675,683 discloses a transmitter positioned intermediate the arrowhead and the nock of a hunting arrow. The transmitter is provided as an extension of the arrow between the main body of the arrow and the arrowhead. The shaft of the arrow serves as the antenna for the transmitter and the transmitter remains with the arrow at all times. The transmitter is turned on by removing a pin from the arrow shaft which in turn allows a switch to close and activate the transmitter. U.S. Pat. No. 4,704,612 issued Nov. 3, 1987, discloses a radio frequency transmitting arrow containing a power supply, an inertia-activation switch, and a directional responsive radio receiver. The inertia switch uses a torsion spring to contact a conductor during arrow acceleration only, as it leaves the bow, thereby activating the transmitter.

The foregoing patents have addressed the problem of errant shots and successful shots wherein the arrow remains imbedded in the quarry, but other problems have not been addressed. It should be noted that in three of the four of the above cases transmitter activation requires manual operation of a switch by the archer. There are drawbacks to this type of switch action. First, it takes perhaps one or two seconds to hold the arrow and turn, pull, or push the switch, which delays the firing at a critical time. Second, the archer may not shoot the arrow but remove it and replace it in the quiver and fail to turn off the switch, or the switch may be inadvertently activated in the quiver, during transport. In both cases, the result may be a dead battery and a non-functioning transmitter. Finally, in the event the contact does not close during acceleration, i.e. shooting the arrow, the transmitter again will not energize. It is the purpose of this invention to provide an inertia switch for an arrow that activates during acceleration and deceleration, as the arrow hits the target or ground, as the case may be. Actuation causes the radio transmitter to commence signal generation that is located by a direction-responsive receiver.

SUMMARY OF THE INVENTION

In accordance with the present invention, an inertial acceleration and deceleration electric switch is provided, that will activate electrical circuits upon acceleration or deceleration. In the preferred embodiment, the switch generally stated comprises a metallic housing containing a movable metal mass. The mass is maintained in a middle portion of the housing by a pair of compression springs providing electrical contact between the housing and the mass. A lower electrical contact insulated from the housing, is contacted by the mass during acceleration of the switch and a second upper electrical contact is contacted during deceleration of the switch.

When used as a switch within a radio transmitter arrow, the lower switch closes during acceleration from the bow and the second upper switch closes during deceleration as the arrow hits the target, a tree, or the ground. In either case, the switch activation turns on the transmitter so that a directional-responsive radio receiver can track the arrow location.

It should be noted that the invention described is in terms of a miniature switch for a radio transmitting arrow, there are multiple other uses for this simple, effective, inexpensive switch, i.e. radios, automobiles, air bag actuators, detonators, and the like.

DETAILED DESCRIPTION OF THE INVENTION

There are many applications for motion-sensing devices that can activate or de-activate electrical or electronic equipment. Often, it is desirable to activate equipment only as long as needed, where activation is needed only during or after equipment motion commences or ceases.

In the case of a radio transmitting arrow, activation can be initiated during the 300 g acceleration occurring as the arrow accelerates from 0 to 200 plus feet per second as it leaves the bow. Deceleration occurs at the end of travel where the arrow strikes a target animal, a tree, or, perhaps, the ground. Having a switch that activates on both acceleration and deceleration provides added assurance that inadequate contract of one switch can be overcome by operation of the other. In this case, the switches would operate in a parallel circuit between a battery terminal and a radio transmitter circuit that "seals in" to maintain the radio "on" until de-activated after locating the arrow.

Figure 1:
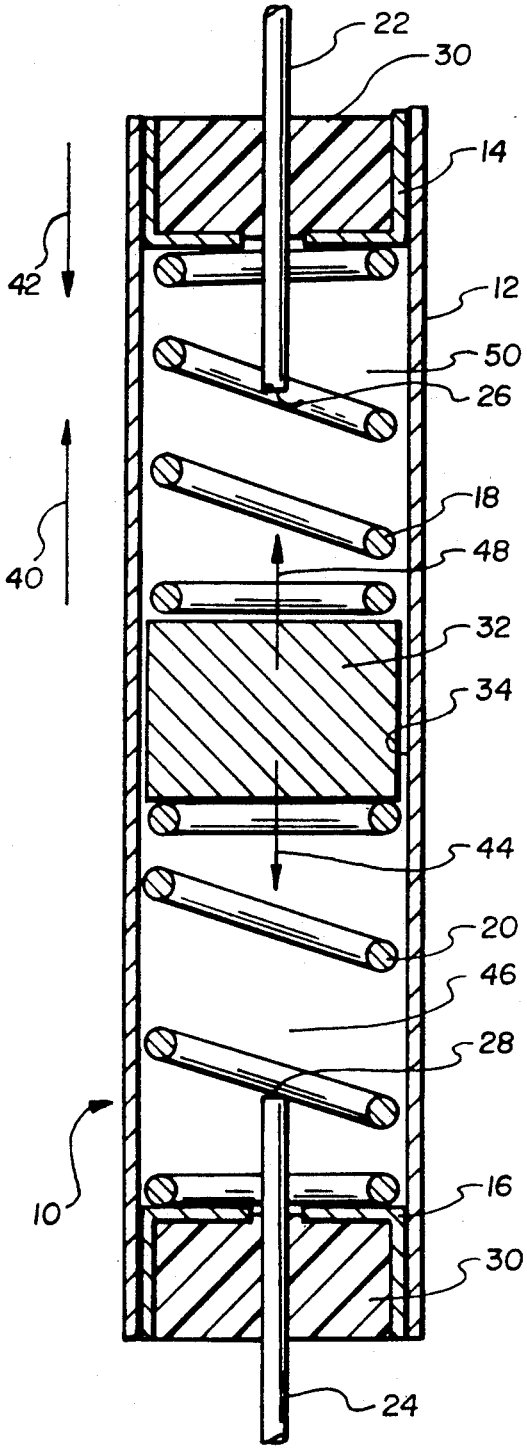
FIG. 1 is a side section view of the acceleration and deceleration switch constructed in accordance with the invention.

Referring now to FIG. 1, acceleration-deceleration switch 10 is illustrated as contained within housing 12. Parts in FIG. 1, for convenience, will be described in terms of "upper" and "lower", but it should be noted that the switch in normal configuration within an arrow is typically in a horizontal or generally horizontal plane as opposed to the vertical configuration of FIGS. 1 and 2.

Metal housing 12 contains upper and lower generally cupshaped metal caps 14 and 16, which are retained, and in electrical contact, with a pair of helical compression springs 18 and 20. Conductors 22 and 24 have at their ends an upper electrical contact 26 and a lower electrical contact 28, isolated from both the housing 12 and the upper and lower caps 14 and 16 by use of a generally cylindrical-shaped glass or epoxy insulator 30.

Also contained within the housing 12 is a movable metal inertia mass 32 centered at a middle housing portion 34 by the pair of springs 18 and 20. In this "at rest" condition, there is no electrical connection made between either the upper or lower contacts 26 and 28 and the mass 32. There is only electrical connection between the housing 12, the caps 14 and 16, and the springs 18 and 20.

Operation of the switch 10 will be described in terms of acceleration of the switch in direction of arrow 40 and deceleration of the switch as at 42. Acceleration causes inertia mass 32 to move in direction 44, overcoming compression spring 20 until the lower face of inertia mass 32 contacts the lower contact 28, thereby completing an electrical path between housing 12 and conductor 24. The inertia mass remains in the lower housing portion 46 of housing 12 during the acceleration period. At the end of acceleration period, inertia mass 32 returns to the middle portion 34 until deceleration as at 42 occurs.

Deceleration causes inertia mass 32 to move in direction 48 overcoming compression spring 18, until the upper face of inertia mass 32 contacts upper contact 26. This completes second electrical path between housing 12 and conductor 22 as long as inertia mass 32 remains in upper portion 50.

Figure 4A:
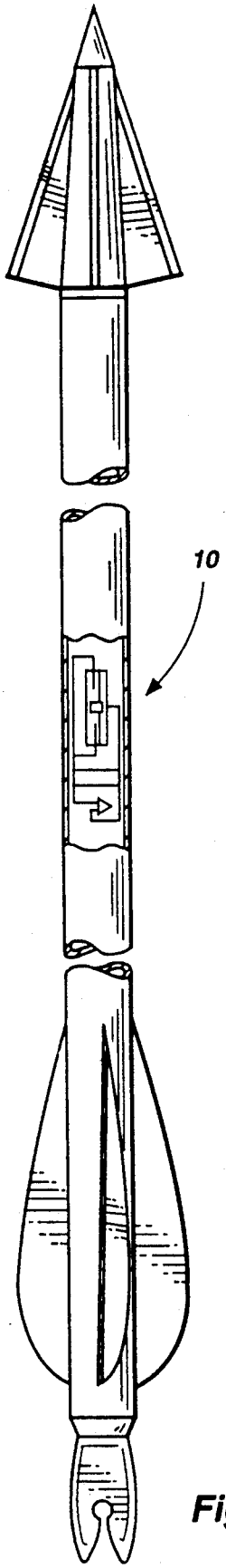
FIG. 4A is a diagrammatic view showing the preferred location of the acceleration and deceleration switch in a hunting arrow.
Figure 4:
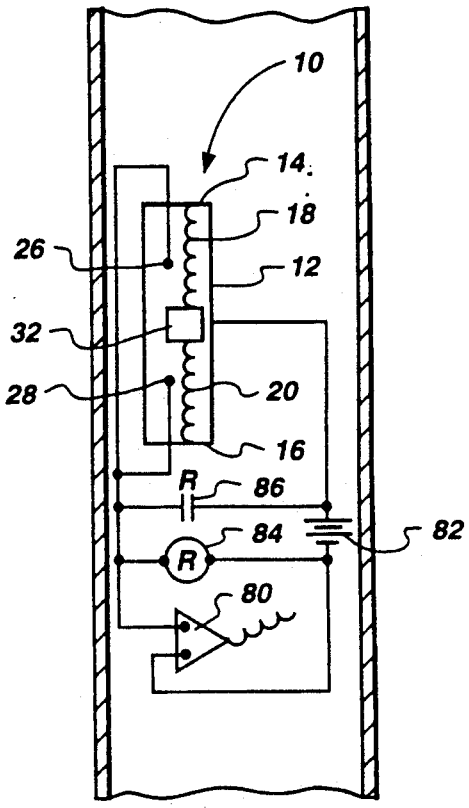
FIG. 4 is an electrical schematic of the acceleration and deceleration switch and a hunting arrow.

This switch 10 may be included in an electric circuit which is shown schematically in FIG. 4. This circuit is suitable for use in actuating a transmitter 80 upon making of the electrical contacts 26 or 28. As shown, the circuit also includes a battery 82 and is suitable for mounting in an archer's arrow. FIG. 4A shows the position of the acceleration and deceleration switch 10 in the shaft of a hunting arrow.

In general, the housing 12, the compression springs 18,20, and inertia mass 32 are electrically connected through suitable wiring to a battery 82 and transmitter 80. Acceleration or deceleration of the housing 12 moves the inertia mass 32 into contact with electrical contacts 26 or 28 to complete the circuit to "seal in" relay 84. Relay 84 closes contact 86 to maintain power to transmitter 80. Although a relay circuit is described herein, a simple transistor, solid-state device can be used to provide a "seal in" function.

Figure 2:
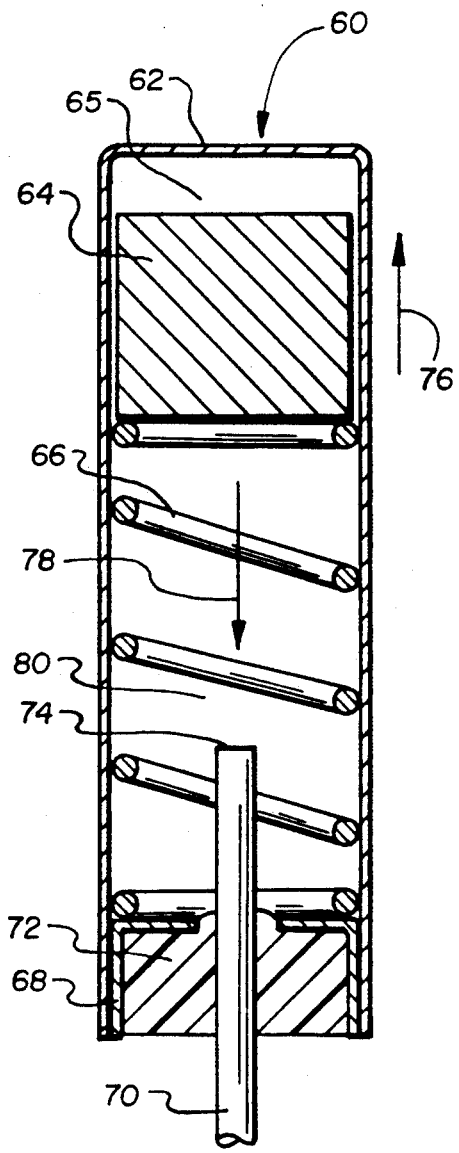
FIG. 2 is a side section view of an acceleration switch, constructed in accordance with an embodiment of the invention.
Figure 3:
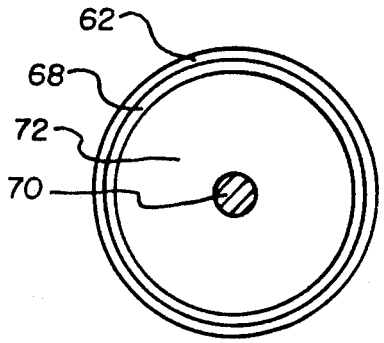
FIG. 3 is a bottom view of the acceleration switch.

Referring to FIGS. 2 and 3, a second embodiment is illustrated, having only a single electrical contact. Switch 60 comprises housing 62, containing inertia mass 64, compression spring 66, cap 68, and conductor 70 insulated from the cap 68 by epoxy 72. As in FIG. 1, conductor 70 has an electrical contact 74 within the housing 12.

As before, acceleration of switch 60 as at arrow 76 causes inertia mass 64 in upperhousing position 65 to compress spring 66 in direction 78 until the inertia mass 64 contacts electrical contact 74. When inertia mass 62 is in this lower housing portion 80, there is again, as above, an electrical path from housing to conductor via the cap 68, spring 66, and inertia mass 62. As is apparent, the switch can also be situated within the arrow to close on deceleration by rotating it end for end at a 180° different orientation.

The electrical schematic for the second embodiment would be the same as FIG. 4 with the exception of only one electrical contact 74 and one compression spring 66.

The FIG. 1 and FIG. 2 switches are relatively small and fit in a typical arrow since they are about 0.075" in diameter by ¼" long, using an aluminum watch crystal can as a housing. The inertia mass is a rod about 0.050" long and constructed of aluminum, brass, bronze, or some other suitable material (leaded steel), gold-plated metal, etc. Springs are plated steel or beryllium copper. The aluminum caps are sealed with an epoxy or glass ceramic. The conductor is aluminum or copper of 0.010–0.015" diameter. The switches are light, inexpensive, simple, durable, and have a minimum number of parts. They can be designed for a relatively large range acceleration and deceleration forces.

It is apparent from the foregoing that a simple yet unobvious inertia switch has been provided. While only two presently preferred embodiments have been described in detail, as will be apparent to those familiar with the art, certain changes and modifications can be made without departing from the scope of the invention as defined by the following claims.

What is claimed is:

1. A system for recovering a hunting arrow including an electric acceleration and deceleration switch comprising:

a. a housing having an upper, middle, and lower portion;

b. a movable inertia mass within the housing;

c. spring means within the upper and lower housing portions for providing electrical contact between the holding and inertia mass and for maintaining the inertia mass in the middle housing portion;

d. an upper electrical contact and an upper contact wire and a lower electrical contact and a lower contact wire, the contact wires in a position which is normally not in contact with the electrical contacts and the contact wires and the electrical contacts being positioned within the upper and lower housing portions, respectively and insulated from said housing, and mounted such that an acceleration of the switch moves the inertia mass to a lower housing position in contact with the lower electrical contact, thereby making a first electrical path between the housing and lower contact wire, and a deceleration of the switch moves the inertia mass to contact the upper electrical contact, thereby making a second electrical path between housing and upper contact wire;

e. at least a portion of an arrow shaft; and f. a transmitter, the transmitter and the housing being located within the portion of the arrow shaft and the transmitter being electrically connected to the first electrical path and the second electrical path.

2. A system for recovering a hunting arrow including an electric acceleration and deceleration switch as recited in claim 1 and wherein the housing and the inertia mass are of cylindrical shape about 0.075" in diameter and about 0.25" long.

3. The system for recovering a hunting arrow as recited in claim 2 and wherein the spring means comprises a pair of compression springs, and the housing has an upper and lower cap to retain the springs and electrical contacts.

4. The system for recovering a hunting arrow as recited in claim 3 and wherein the caps are sealed with an epoxy resin.

5. The system for recovering a hunting arrow as recited in claim 3 and wherein the housing inertia mass and caps are constructed of aluminum, and the springs are beryllium copper.

6. A system for recovering a hunting arrow including an electric acceleration and deceleration switch comprising:

a. a generally cylindrical housing having a hollow interior and formed of an electrically conductive material;

b. a generally cylindrical inertia mass mounted for movement within the housing by acceleration or deceleration of the housing;

c. a pair of electrical contacts mounted at a first and second end of the housing, respectively and a pair of insulators, the insulators insulating the electrical contacts from the housing, the electrical contacts being mounted in generally cylindrical-shaped insulators;

d. a pair of electrically conductive compression springs electrically contacted to the inertia mass and to the housing and mounted in the housing to bias the inertia mass away from the electric contacts such that acceleration or deceleration of the housing moves the inertia mass to compress the compression springs and initiate electrical contact between the inertia mass, the electrical contacts, and the housing;

e. an archer's arrow, the housing being mounted within the archer's arrow; and f. a transmitter, the transmitter being positioned within the arrow and being electrically connected to the electrical contacts such that the transmitter emits a signal capable of being detected by a receiver after the arrow has been accelerated or decelerated.

7. The system for recovering a hunting arrow as recited in claim 6 and wherein:

the insulators are mounted in a generally cupshaped caps which provide electrical contact for the inertia mass, the compression springs, and the housing.

8. The system for recovering a hunting arrow as recited in claim 7 and wherein:

the housing is fabricated of an aluminum watch crystal can.

9. The system for recovering a hunting arrow as recited in claim 8 and wherein:

the inertia mass is formed as a rod about 0.050" in length.

10. A system for recovering an archer's arrow after the arrow has been released from a bow comprising:

an arrow having a hollow shaft with a first end having a nock and a second end having an arrowhead;

a transmitter, the transmitter emitting a signal capable of being detected by a receiver when the transmitter is activated;

a movable inertia mass located within the hollow shaft such that the inertia mass can move toward the first end of the arrow and toward the second end of the arrow;

first biasing means for exerting a biasing force against the inertia mass such that the inertia mass moves toward the first end of the hollow shaft only upon acceleration of the arrow;

second biasing means for exerting a biasing force against the inertia mass such that the inertia mass moves toward the second end of the hollow shaft only upon deceleration of the arrow;

first electrical contact means positioned between the first end of the arrow and the inertia mass, the inertia mass meeting the first electrical contact means when the arrow is subject to acceleration of a threshold level, the first electrical contact means being electrically connected to the transmitter such that the transmitter is activated upon acceleration of the arrow; and second electrical contact means positioned between the second end of the arrow and the inertia mass, the inertia mass meeting the second electrical contact means when the arrow is subject to deceleration of a threshold level, the second electrical contact means also being electrically connected to the transmitter such that the transmitter is activated upon deceleration of the arrow, such that the transmitter is activated upon acceleration from an archer's bow and, if not activated upon acceleration from the archer's bow, upon deceleration of the arrow when striking an object.

* * * * *